United States Patent [19]

Masumoto et al.

[11] 3,986,867

[45] Oct. 19, 1976

[54] IRON-CHROMIUM SERIES AMORPHOUS ALLOYS

[75] Inventors: Tsuyoshi Masumoto, Sendai; Masaaki Naka, Izumi, both of Japan

[73] Assignees: The Research Institute for Iron, Steel and Other Metals of the Tohoku University, Sendai; Nippon Steel Corporation, Tokyo, both of Japan

[22] Filed: Jan. 13, 1975

[21] Appl. No.: 540,462

[30] Foreign Application Priority Data

Jan. 12, 1974 Japan ..... 49-6330
July 1, 1974 Japan ..... 49-74245

[52] U.S. Cl. ..... 75/126 A; 75/122; 75/125; 75/126 B; 75/126 C; 75/126 D; 75/126 H; 75/126 P; 75/126 K; 75/128 A; 75/128 D; 75/128 P; 75/128 F; 75/128 G; 75/128 Z; 75/128 T; 75/128 W; 75/128 V; 75/134 F

[51] Int. Cl.[2] ..... C22C 38/32; C22C 38/36; C22C 38/54; C22C 38/56

[58] Field of Search ..... 75/122, 134 F, 125, 75/126 A, 126 B, 126 C, 126 D, 126 E, 126 H, 126 P, 126 K, 128 A, 128 D, 128 P, 128 F, 128 G, 128 Z, 128 T, 128 W, 128 V

[56] References Cited

UNITED STATES PATENTS

| | | | |
|---|---|---|---|
| 3,856,513 | 12/1974 | Chen et al. | 75/122 |
| 3,871,836 | 3/1975 | Polk et al. | 29/196 X |

*Primary Examiner*—Arthur J. Steiner
*Attorney, Agent, or Firm*—Sughrue, Rothwell, Mion, Zinn and Macpeak

[57] ABSTRACT

Iron-chromium series amorphous alloys having excellent mechanical properties, high heat resistance and corrosion resistance consisting essentially of 1–40 atomic % of chromium, 7–35 atomic % of at least one of carbon, boron and phosphorus and the remainder being iron. In said amorphous alloys, a part of the content of iron may be substituted with at least one subcomponent selected from the group consisting of nickel, cobalt, molybdenum, zirconium, titanium, manganese, vanadium, niobium, tungsten, tantalum and copper.

11 Claims, 1 Drawing Figure

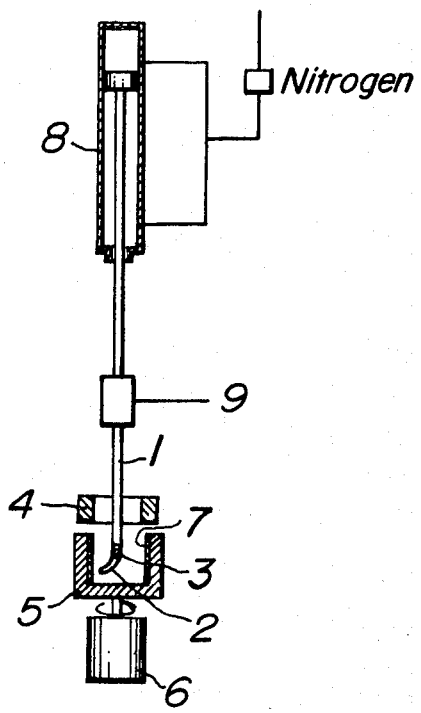
Nitrogen
8
9
1
4
7
3
5
2
6

IRON-CHROMIUM SERIES AMORPHOUS ALLOYS

The present invention is concerned with iron-chromium series amorphous alloys having excellent mechanical properties, corrosion resistance and heat resistance.

Metals and alloys prepared by conventional methods are usually crystalline, i.e. the atoms arrange in an orderly manner. However, certain metals and alloys with particular compositions can be made to have non-crystalline structures which are similar to that of liquids, when they are solidified by rapid quenching. The non-crystalline solids of these metals and alloys are referred to as "amorphous metals".

As compared with conventional practical metals, the amorphous metals have favorable mechanical properties, while their corrosion resistance is usually very poor. For example, the weight loss of Fe-P-C and Fe-B-P series amorphous alloys by salt spray testing is about three times higher than that of plain carbon steel.

Generally, amorphous metals are converted into crystalline solids when heated to a certain temperature (crystallization temperature) which is determined by the respective alloy compositions, thus losing peculiar properties arised from the particular atomic arrangement of the non-crystalline nature. In practice, the environmental temperature of materials is not restricted to room temperature. Therefore, for practical applications of amorphous metals, it is desired to develop stable materials with higher crystallization temperatures.

The iron-chromium series amorphous alloys according to the present invention have the following characteristics; easy production, high heat resistance, high corrosion resistance and excellent mechanical properties. Especially, the excellent corrosion resistance of the present amorphous alloys containing 5–40 atomic % of chromium is far superior to that of commercial stainless steels which are widely used at present; practically no pitting and crevice corrosion, unsusceptible to stress corrosion cracking and hydrogen embrittlement.

The object of the present invention is to provide amorphous alloys consisting essentially of 1–40 atomic % of chromium, 7–35 atomic % of at least one of carbon, boron and phosphorus and balancing iron.

Namely, the amorphous alloys of the present invention involve the following series, Fe-Cr-C, Fe-Cr-B, Fe-Cr-C-B, Fe-Cr-P, Fe-Cr-C-P, Fe-Cr-B-P and Fe-Cr-C-B-P.

The preferable content of carbon, boron or phosphorus is 15–25 atomic %.

When a combination of carbon and/or boron with phosphorus is used, the content of carbon and/or boron can be widened to 2–30 atomic % and the content of phosphorus is 5–33 atomic % and the total content of carbon and/or boron and phosphorus is 7–35 atomic %. In this case, the most favorable properties are obtained in the alloys having the content of carbon and/or boron being 5–10 atomic % and the content of phosphorus being 8–15 atomic %.

In the present invention, chromium has an effect for improving the mechanical properties, corrosion resistance and heat resistance of the amorphous alloys, and the partial replacement of carbon and/or boron with phosphorus is for the easy formation of the amorphous state in these alloys.

The reason for limiting the composition range of the alloys in the present invention will be described below.

The addition of chromium less than 1 atomic % is not effective for the improvement of mechanical, thermal and corrosive properties, while the addition over 40 atomic % makes it difficult to attain an amorphous state even with rapid quenching.

The content of at least one of carbon, boron and phosphorus should be in the range from 7–35 atomic %, since the amorphous state can only be attained for the alloys within the composition range.

Furthermore, it has been found that when a part of the content of iron in the iron-chromium alloys containing at least one of the amorphous phase forming elements of carbon, boron and phosphorus is substituted with at least one of nickel, cobalt, molybdenum, zirconium, titanium, manganese, vanadium, niobium, tungsten, tantalum and copper, the amorphous alloys having more excellent properties can be obtained.

In this case, the content of Ni or Co is less than 40 atomic %.

The content of Mo, Zr, Ti and Mn is less than 20 atomic %.

The content of V, Nb, W, Ta or Cu is less than 10 atomic %.

These elements have the following effects.

1. Stabilizing elements of the amorphous structure: Ni, Co, Mo.
2. Effective elements for the mechanical properties: Mo, Zr, Ti, V, Nb, Ta, W, Co, Mn.
3. Effective elements for the heat resistance: Mo, Zr, Ti, V, Nb, Ta, W.
4. Effective elements for the corrosion resistance: Ni, Cu, Mo, Zr, Ti, V, Nb, Ta, W.

The reason why the upper limits of these elements are defined as described above, is based on the fact that even if the contents of these elements are increased over the above described upper limits, the addition effect is not substantially obtained.

The amorphous alloys of the present invention can be produced in the form of a strip, ribbon, foil, powder or a thin sheet and have very excellent mechanical properties which have never been obtained in the conventional practical metal materials, and an excellent heat resistance. Accordingly, the amorphous alloys of the present invention are suitable for the articles requiring high strength and heat resistance, for example reinforcing cords embedded in rubber or plastic products, such as vehicle tires, belts and the like and suitable for filters, screens, filaments for mixspinning with fibers and the like.

Furthermore, the iron-chromium series amorphous alloys of the present invention have extremely high resistivity against pitting corrosion, crevice corrosion, stress corrosion cracking and hydrogen embrittlement as compared with corrosion resistant crystalline steels. This is attributable to the facts that a large amount of semi-metallic elements is added to the alloys, which significantly accelerates the formation of corrosion-resistive surface film consisting mainly of chromium oxyhydroxide and bound water, and no crystal defects acting as the sites for initiation and propagation of corrosion exist in the alloys. Accordingly, the amorphous alloys of the present invention are suitable for materials of apparatus to be used in river, lake and seawater as well as in marine, industrial and rural atmospheres, and parts for in hydraulic, atomic energy and other various power plants, chemical industrial plants and the like.

The amorphous alloys of the present invention may be produced by the conventional processes, for example, quenching technique, deposition technique and the like.

An explanation will be made with respect to a preferable process for producing the wire or strip alloys of the present invention with reference to the accompanying drawing.

The Figure is a diagrammatic view of an apparatus for producing the amorphous alloy of the present invention.

In the Figure, 1 is a quartz tube provided with a nozzle 2 at the lower end, which jets the fused metal horizontally, and in which a starting metal 3 is charged and fused. 4 is a heating furnace for heating the starting metal 3 and 5 is a rotary drum rotated at a high speed, for example, 5,000 r.p.m. by a motor 6. Said drum is constructed of a light metal having a high heat conductivity, for example, aluminum alloy and the inner wall is lined with a metal having a high heat conductivity, for example, a copper sheet 7. 8 is an air piston for supporting the quartz tube 1 and moving it upwardly and downwardly. The starting metal is charged in the quartz tube 1 and heated and fused at a position of the heating furnace 4 and then the quartz tube 1 is descended to a position as shown in the Figure by the air piston 8 so that the nozzle 2 is opposed to the inner wall of the rotary drum 5 and then the tube 1 is lifted and simultaneously an inert gas pressure is applied to the fused metal 3 and the fused metal is jetted toward the inner wall of the rotary drum. In order to prevent oxidation of the starting metal 3, an inert gas 9, for example, gaseous argon is fed into the quartz tube to maintain the interior of the tube under an inert atmosphere. The fused metal jetted toward the inner wall of the rotary drum comes in contact forcedly with the inner wall of the rotary drum by the centrifugal force owing to the high speed rotation, whereby a super high cooling rate is obtained to provide the amorphous alloy. By such a method, a ribbon-shaped amorphous alloy having a thickness of 0.2 mm and a breadth of 10 mm can be obtained.

The following examples are given in illustration of this invention and are not intended as limitations thereof.

Example 1

Amorphous alloys having compositions as shown in the following Table 1 were made into strips having a thickness of 0.05 mm and a width of 0.5 mm by means of the apparatus as shown in FIG. 1.

Table 1

| Component | Fe-Cr-C-P (atomic %, Fe: balance) Alloy No. 1 | 2 | 3 | 4 | 5 | 6 | Fe-Cr-B-P (atomic %, Fe: balance) Alloy No. 7 | 8 | 9 | 10 | 11 | 12 |
|---|---|---|---|---|---|---|---|---|---|---|---|---|
| C | 5 | 5 | 5 | 5 | 5 | 5 | | | | | | |
| B | | | | | | | 5 | 5 | 5 | 5 | 5 | 5 |
| P | 15 | 15 | 15 | 15 | 15 | 15 | 15 | 15 | 15 | 15 | 15 | 15 |
| Cr | 0 | 1 | 5 | 10 | 20 | 40 | 0 | 1 | 5 | 10 | 20 | 40 |

Each of these strips was tested on mechanical properties, corrosion resistance and heat resistance to obtain results as shown in the following Tables 2, 3 and 4.

For comparison, results by the same corrosion test are shown in Table 3 with respect to a common 0.8% carbon steel and chromium steels.

The corrosion tests were carried out using about 100 mg of the amorphous alloy strip and the wire of the carbon steel or chromium steel having a diameter of 0.12 mm as a specimen. In this test, weight loss by corrosion of these specimens was measured in an air-conditioned atmosphere (60° C, 95% RH) and in a 5% NaCaqueous solution (35° C). The heat resistance was also evaluated by comparison with crystallization temperature of the alloy specimen obtained by measurements of electric resistance and differential thermal analysis, in which the heating rate was 1° C/min.

Table 2

| Alloy No. | | Chromium content x(atomic %) | Mechanical properties of amorphous alloys: Yield strength (Kg/mm²) | Fracture strength (Kg/mm²) | Elongation (%) | Hardness (Hv) | Young's modulus (Kg/mm²) |
|---|---|---|---|---|---|---|---|
| $Fe_{80-x}Cr_xP_{15}C_5$ | 1 | 0 | 235 | 310 | 0.05 | 760 | $12.4\times10^3$ |
| | 2 | 1 | 235 | 310 | 0.03 | 760 | $12.4\times10^3$ |
| | 3 | 5 | 288 | 325 | 0.02 | 880 | $12.6\times10^3$ |
| | 4 | 10 | 300 | 350 | 0.02 | 960 | $12.8\times10^3$ |
| | 5 | 20 | 350 | 385 | 0.02 | 1,070 | $13.3\times10^3$ |
| | 6 | 40 | 350 | 350 | 0.01 | 1,160 | $14.5\times10^3$ |
| $Fe_{80-x}Cr_xP_{15}B_5$ | 7 | 0 | 240 | 300 | 0.05 | 770 | $12.5\times10^3$ |
| | 9 | 5 | 310 | 355 | 0.05 | 950 | — |
| | 10 | 10 | 320 | 360 | 0.05 | 980 | — |
| | 11 | 20 | 350 | 400 | 0.02 | 1,010 | — |
| | 12 | 40 | 310 | 310 | 0.02 | 1,150 | — |

Table 3

Results of corrosion tests

| Alloy No. | Alloy composition (atomic %) | Corrosion condition | Weight loss by corrosion (wt.%): 0 | 5 hours | 24 hours | 72 hours |
|---|---|---|---|---|---|---|
| 1 | $Fe_{80}$-$P_{15}$-$C_5$ | | 0 | 12.5 | 15.1 | 30.5 |
| 2 | $Fe_{79}$-$Cr_1$-$P_{15}$-$C_5$ | | 0 | 5.2 | 10.1 | 15.9 |
| 3 | $Fe_{75}$-$Cr_5$-$P_{15}$-$C_5$ | | 0 | 1.0 | 1.4 | 2.0 |
| 4 | $Fe_{70}$-$Cr_{10}$-$P_{15}$-$C_5$ | | 0 | 0.0 | 0.0 | 0.0 |
| 5 | $Fe_{60}$-$Cr_{20}$-$P_{15}$-$C_5$ | | 0 | 0.0 | 0.0 | 0.0 |

Table 3-continued

Results of corrosion tests

| Alloy No. | Alloy composition (atomic %) | Corrosion condition | Weight loss by corrosion (wt.%) 0 | 5 hours | 24 hours | 72 hours |
|---|---|---|---|---|---|---|
| 6 | $Fe_{40}$-$Cr_{40}$-$P_{15}$-$C_5$ | Immersed in 5% NaCl aqueous solution at 35° C | 0 | 0.0 | 0.0 | 0.0 |
| 7 | $Fe_{80}$-$P_{15}$-$B_5$ | | 0 | 10.5 | 14.8 | 25.5 |
| 9 | $Fe_{75}$-$Cr_5$-$P_{15}$-$B_5$ | | 0 | 0.5 | 0.5 | 1.5 |
| 10 | $Fe_{70}$-$Cr_{10}$-$P_{15}$-$B_5$ | | 0 | 0.0 | 0.0 | 0.0 |
| 11 | $Fe_{60}$-$Cr_{20}$-$P_{15}$-$B_5$ | | 0 | 0.0 | 0.0 | 0.0 |
| 12 | $Fe_{40}$-$Cr_{40}$-$P_{15}$-$B_5$ | | 0 | 0.0 | 0.0 | 0.0 |
| Comparative | 0.8% carbon steel (piano wire) | | 0 | 4.9 | 12.1 | 12.8 |
| | $Fe_{90}$-$Cr_{10}$ (chromium steel) | | 0 | 0.0 | 0.0 | 1.1 |
| | $Fe_{80}$-$Cr_{20}$ (chromium steel) | | 0 | 0.0 | 0.0 | 0.0 |
| | $Fe_{60}$-$Cr_{40}$ (chromium steel) | | 0 | 0.0 | 0.0 | 0.0 |
| 1 | $Fe_{80}$-$P_{15}$-$C_5$ | Exposed in air at 60° C and 95% RH | 0 | 14.3 | 28.6 | 35.4 |
| 2 | $Fe_{79}$-$Cr_1$-$P_{15}$-$C_5$ | | 0 | 10.1 | 12.2 | 15.6 |
| 3 | $Fe_{75}$-$Cr_5$-$P_{15}$-$C_5$ | | 0 | 1.3 | 1.7 | 2.0 |
| 4 | $Fe_{70}$-$Cr_{10}$-$P_{15}$-$C_5$ | | 0 | 0.0 | 0.0 | 0.0 |
| 5 | $Fe_{60}$-$Cr_{20}$-$P_{15}$-$C_5$ | | 0 | 0.0 | 0.0 | 0.0 |
| 7 | $Fe_{80}$-$P_{15}$-$B_5$ | | 0 | 11.5 | 16.6 | 21.5 |
| 9 | $Fe_{75}$-$Cr_5$-$P_{15}$-$B_5$ | | 0 | 1.1 | 5.6 | 6.6 |
| 10 | $Fe_{70}$-$Cr_{10}$-$P_{15}$-$B_5$ | | 0 | 0.0 | 0.0 | 0.0 |
| 11 | $Fe_{60}$-$Cr_{20}$-$P_{15}$-$B_5$ | | 0 | 0.0 | 0.0 | 0.0 |
| Comparative | 0.8% carbon steel (piano wire) | | 0 | 5.3 | 10.5 | 12.6 |
| | $Fe_{90}$-$Cr_{10}$ (chromium steel) | | 0 | 0.0 | 0.1 | 0.5 |
| | $Fe_{80}$-$Cr_{20}$ (chromium steel) | | 0 | 0.0 | 0.0 | 0.0 |

Table 4

Heat resistance of amorphous alloys

| | Alloy No. | Chromium content x(atomic %) | Crystallization temperature (%) |
|---|---|---|---|
| $Fe_{80-x}Cr_xP_{15}C_5$ | 1 | 0 | 420 |
| | 2 | 1 | 440 |
| | 3 | 5 | 460 |
| | 4 | 10 | 465 |
| | 5 | 20 | 480 |
| | 6 | 40 | 510 |
| $Fe_{80-x}Cr_xP_{15}B_5$ | 7 | 0 | 415 |
| | 9 | 5 | 450 |
| | 10 | 10 | 455 |
| | 11 | 20 | 485 |
| | 12 | 40 | 515 |

As seen from Table 2, the addition of chromium increases the strength, hardness and Young's modulus, but slightly decreases the elongation. Moreover, the alloy of the present invention shows a local viscous fracture inherent to the amorphous state different from a so-called brittle material although it has a little elongation.

As seen from Table 3, the corrosion resistance of the alloy is considerably improved by the addition of chromium. The Fe-C-P and Fe-B-P series amorphous alloys containing no chromium show serious corrosion in the NaCsolution and in the air-conditioned atmosphere, and suffer pitting corrosion throughout the surface. On the contrary, if the above alloy is added with at least 1 atomic % of chromium, the weight loss by corrosion reduces by half and is substantially equal to that of the carbon steel. Further, by adding 5 atomic % of chromium, the weight loss reduces below about 1/10. In case of adding more than 10 atomic % of chromium, the corrosion hardly proceeds, and the weight loss is not detected even after 72 hours like the high chromium steel.

As seen from Table 4, the addition of chromium raises the crystallization temperature of the amorphous alloy. For instance, the crystallization temperature of the amorphous alloy containing no chromium is raised from about 420° C to about 510° C by adding 40 atomic % of chromium. This addition effect of chromium is remarkable at a small chromium content, and particularly the addition of 10 atomic % of chromium raises the crystallization temperature by about 40° C.

Example 2

Amorphous alloys having compositions as shown in the following Table 5 were made into strips having a thickness of 0.05 mm and a width of 0.5 mm by means of the apparatus as shown in FIG. 1.

Table 5

Fe-Cr-C-B-P series alloy (atomic %, Fe: balance)

| Component | Alloy No. 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| C | 2 | 15 | 1 | 5 | 5 | 5 | 1 | 5 | 5 | 2 | 5 | 5 | 5 | 5 |
| B | 5 | 15 | 1 | 5 | 5 | 5 | 1 | 5 | 10 | 2 | 5 | 5 | 5 | 5 |
| P | 0 | 0 | 10 | 10 | 20 | 25 | 20 | 20 | 20 | 30 | 10 | 10 | 10 | 10 |
| Cr | 10 | 10 | 10 | 10 | 10 | 10 | 10 | 10 | 10 | 10 | 1 | 20 | 30 | 40 |

Each of these strips was tested on mechanical properties to obtain results as shown in the following Table 6. For comparison, the mechanical properties of 405 stainless steel (Cr 13%, Al 0.2%) are also shown as Alloy No. 15 in Table 6.

Table 6

| Alloy No. | Yield strength (Kg/mm²) | Fracture strength (Kg/mm²) | Elongation (%) | Hardness (Hv) |
|---|---|---|---|---|
| 1 | 260 | 330 | 0.02 | 830 |
| 2 | 300 | 380 | 0.02 | 870 |
| 3 | 280 | 350 | 0.03 | 850 |
| 4 | 340 | 410 | 0.02 | 930 |
| 5 | 350 | 400 | 0.01 | 950 |
| 6 | 360 | 390 | 0.01 | 1,000 |
| 7 | 290 | 360 | 0.01 | 870 |
| 8 | 340 | 400 | 0.01 | 910 |
| 9 | 300 | 370 | 0.02 | 990 |
| 10 | 280 | 350 | 0.02 | 810 |
| 11 | 230 | 310 | 0.03 | 800 |
| 12 | 300 | 400 | 0.01 | 890 |
| 13 | 350 | 380 | 0.01 | 950 |
| 14 | 350 | 350 | 0.01 | 1,010 |
| 15 | 25 | 45 | 30 | 180 |

As seen from Table 6, even the alloys No. 1 and No. 2 containing no phosphorus are considerably superior in the strength and hardness to the conventional 405 stainless steel. Furthermore, the alloy No. 6 containing 25 atomic % of phosphorus among the phosphorus-containing alloys No. 3 to No. 14 has maximum values of yield strength (360 Kg/mm²) and hardness (1,000 Hv) as far as the chromium content is constant (10 atomic %).

The following Table 7 shows crystallization temperature of the alloy according to the present invention having the composition shown in Table 5.

Table 7

| Alloy No. | Crystallization temperature (° C) |
|---|---|
| 1 | 425 |
| 2 | 440 |
| 3 | 430 |
| 4 | 460 |
| 5 | 480 |
| 6 | 495 |
| 7 | 425 |
| 8 | 460 |
| 9 | 475 |
| 10 | 420 |
| 11 | 425 |
| 12 | 440 |
| 13 | 480 |
| 14 | 510 |

As seen from Table 7, the crystallization temperature of the Fe-C-P and Fe-B-P series amorphous alloys containing no chromium is about 410° C, while that of the alloy according to the present invention rises with the increases of chromium content and is 510° C at the chromium content of 40 atomic %.

Example 3

Amorphous alloys having compositions as shown in the following Table 8 were made into strips having a thickness of 0.05 mm and a width of 0.5 mm by means of the apparatus as shown in FIG. 1.

Table 8

| Alloy No. | Fe-Cr-C-P (atomic %, Fe: balance) | | | | | | | | | Fe-Cr-B-P (atomic %, Fe: balance) | | | | | | | | |
|---|---|---|---|---|---|---|---|---|---|---|---|---|---|---|---|---|---|---|
| Component | 1 | 2 | 3 | 4 | 5 | 6 | 7 | 8 | 9 | 10 | 11 | 12 | 13 | 14 | 15 | 16 | 17 | 18 |
| C | 2 | 5 | 10 | 2 | 2 | 2 | 2 | 25 | 30 | | | | | | | | | |
| B | | | | | | | | | | 2 | 5 | 10 2 | 2 | 2 | 2 | 25 | 30 | |
| P | 5 | 5 | 5 | 10 | 13 | 28 | 33 | 5 | 5 | 5 | 5 | 5 | 10 | 13 | 28 | 33 | 5 | 5 |
| Cr | 10 | 10 | 10 | 10 | 10 | 10 | 10 | 10 | 10 | 10 | 10 | 10 | 10 | 10 | 10 | 10 | 10 | 10 |

Each of these strips was tested on mechanical properties to obtain results as shown in the following Table 9. For comparison, mechanical properties of 405 stainless steel (Cr 13%, Al 0.2%) are also shown as Alloy No. 19 in the Table 9.

Table 9

| Alloy No. | Yield strength (Kg/mm²) | Fracture strength (Kg/mm²) | Elongation (%) | Hardness (Hv) |
|---|---|---|---|---|
| 1 | 250 | 310 | 0.05 | 850 |
| 2 | 260 | 310 | 0.07 | 860 |
| 3 | 280 | 300 | 0.02 | 880 |
| 4 | 250 | 350 | 0.05 | 890 |
| 5 | 260 | 370 | 0.05 | 910 |
| 6 | 290 | 380 | 0.05 | 950 |
| 7 | 290 | 390 | 0.07 | 980 |
| 8 | 300 | 340 | 0.01 | 1,010 |
| 9 | 290 | 320 | 0.01 | 1,050 |
| 10 | 240 | 300 | 0.04 | 850 |
| 11 | 250 | 330 | 0.04 | 850 |
| 12 | 250 | 350 | 0.002 | 890 |
| 13 | 210 | 310 | 0.01 | 880 |
| 14 | 230 | 330 | 0.01 | 890 |
| 15 | 270 | 340 | 0.01 | 920 |
| 16 | 290 | 350 | 0.01 | 950 |
| 17 | 290 | 370 | 0.02 | 950 |
| 18 | 290 | 370 | 0.03 | 1,000 |
| 19 | 25 | 45 | 30 | 180 |

As seen from Table 9, the alloys according to the present invention have considerably high strength and hardness and a few elongation as compared with the conventional 405 stainless steel.

Particularly, the alloy No. 7 of the present invention has a fracture strength of as high as 390 Kg/mm².

The following Table 10 shows the crystallization temperature of the alloys having the composition shown in Table 8.

Table 10

| Alloy No. | Crystallization temperature (° C) |
|---|---|
| 1 | 420 |
| 3 | 440 |
| 5 | 460 |
| 7 | 450 |
| 9 | 460 |
| 10 | 440 |
| 13 | 460 |
| 16 | 450 |
| 18 | 440 |

As seen from Table 10, the crystallization temperature of the Fe-C-P and Fe-B-P series alloys containing no chromium is about 410° C, while the addition of 10 atomic % of chromium holds almost constant crystallization temperature (about 450° C) regardless of variations in amount of P and C or B.

As mentioned above, the Fe-Cr series amorphous alloy according to the present invention has such an advantage that not only the mechanical strength but also the heat resistance are increased by the addition of chromium. On the other hand, the addition of C and/or B is necessary for forming an amorphous alloy and the lower limit of total content of C and B may be widened by the addition of P. The addition of C, B and P is particularly effective in an industrial production because it mitigates quenching and solidying conditions to a certain extent as compared with the addition of C and P or B and P. That is, an amorphous alloy having improved mechanical strength, corrosion resistance and heat resistance can be obtained within the composition range of the present invention as mentioned above.

Example 4

Amorphous alloys having compositions as shown in the following Table 11 were made into strips having a thickness of 0.05 mm and a width of 1 mm by means of the apparatus as shown in FIG. 1 and then subjected to various corrosion tests.

Table 11

Fe-Cr-B-P series alloy (atomic %)

| Component | Alloy No. 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| Cr | 0 | 1 | 3 | 5 | 8 | 10 | 12 | 15 | 20 | 30 | 40 | 6 | 8 | 10 | 20 | 10 |
| P | 13 | 13 | 13 | 13 | 13 | 13 | 13 | 13 | 13 | 13 | 13 | 13 | 13 | 13 | 13 | 0 |
| C | 7 | 7 | 7 | 7 | 7 | 7 | 7 | 7 | 7 | 7 | 7 | 0 | 0 | 0 | 3.5 | 7 |
| B | 0 | 0 | 0 | 0 | 0 | 0 | 0 | 0 | 0 | 0 | 0 | 7 | 7 | 7 | 3.5 | 7 |
| Fe | 80 | 79 | 77 | 75 | 72 | 70 | 68 | 65 | 60 | 50 | 40 | 74 | 72 | 70 | 60 | 60 |

Crystalline binary Fe-Cr alloys and commercial 18-8 (304) and 17-14-2.5 Mo (316L) stainless steels were used for the same corrosion tests for comparison.

The corrosion data were obtained by total immersion tests, hanging the specimens by plastic wires, in 1M-$H_2SO_4$ and 1N-NaCl solutions and solutions having various concentrations of hydrochloric acid at 30° C for 168 hours. Moreover, in order to examine the susceptibility to crevice corosion, a Teflon plate was placed adjacent to the surface of the sample to form a crevice. The results are shown in the following Tables 12 and 13.

Table 12

Results of corrosion tests in $H_2SO_4$ and NaCl

| Alloy No. | Corrosion rate (mg/cm²/year) 1M-$H_2SO_4$, 30° C | 1N-NaCl, 30° C |
|---|---|---|
| 1 | 4,680 | 4,290 |
| 2 | 870 | 800 |
| 3 | 27.0 | 76.7 |
| 4 | 9.37 | 26.8 |
| 5 | 0.00 | 0.00 |
| 6 | 0.00 | 0.00 |
| 7 | 0.00 | 0.00 |
| 8 | 0.00 | 0.00 |
| 9 | 0.00 | 0.00 |
| 10 | 0.00 | 0.00 |
| 11 | 0.00 | 0.00 |
| 12 | 0.00 | 0.00 |
| 13 | 0.00 | 0.00 |
| 14 | 0.00 | 0.00 |
| 15 | 0.00 | 0.00 |
| 16 | 0.00 | 0.00 |
| 13% Cr steel | 515 | 451 |
| 304 steel | 25.7 | 22 |
| 316L steel | 8.6 | 10 |

Table 13

Results of corrosion test in HCl

| Alloy No. | Concentration of hydrochloric acid (N) 30° C: 0.01 Corrosion rate (mg/cm²/year) | 0.01 Appearance | 0.1 Corrosion rate (mg/cm²/year) | 0.1 Appearance | 0.5 Corrosion rate (mg/cm²/year | 0.5 Appearance | 1 Corrosion rate (mg/cm²/year) | 1 Appearance |
|---|---|---|---|---|---|---|---|---|
| 5–16 | 0.00 | no corrosion | 0.00 | no corrosion | 0.00 | no corrosion | 0.00 | no corrosion |
| 304 steel | 1.03 | general corrosion | 3.28 | general corrosion | 572.2 | general corrosion +pitting +crevice corrosion | 10,210 | general corrosion +pitting +crevice corrosion |

As seen from Table 12, the corrosion rate of the alloy No. 3 containing 3 atomic % Cr is about the same with that of conventional 18-8 stainless steel (304), while the weight loss of the alloy No. 12 containing 6 atomic % chromium and the alloys No. 5–11 and No. 13–16 containing 8 atomic % or more chromium could not be detected by a microbalance. As seen from Table 13, the alloys No. 5–16 do not suffer general corrosion, pitting and crevice corrosion even after 168 hour-immersion. On the contrary, on 304 steel general corrosion, pitting and crevice corrosion occur in 24 hours.

Further, pitting corrosion test was made by immersion in a 10% $FeCl_3 \cdot 6H_2O$ solution, which was usually used in a pitting test for stainless steel, at 40° C or 60° C. The obtained results are shown in the following Table 14.

Table 14

| Results of pitting test | | | | |
|---|---|---|---|---|
| | 10% $FeCl_3.6H_2O$ | | | |
| | 40° C | | 60° C | |
| Alloy No. | Time for appearance of pitting (hour) | Corrosion rate (mg/cm²/year) | Time for appearance of pitting (hour) | Corrosion rate (mg/cm²/year) |
| 5–16 | No pitting even after 168 hour-immersion | 0.00 | No pitting even after 168 hour-immersion | 0.00 |
| 304 steel | 18 | 13.8 | 3 | 93.6 |
| 316L steel | — | — | 8 | 21.4 |

As seen from Table 14, the alloys according to the present invention suffer no pitting and crevice corrosion even at 60° C in the $FeCl_3$ solution, at which the pitting and crevice corrosion occurred in not only 304 and 318L steels but also all other stainless steels practically used.

In order to clarify the high resistivity to pitting corrosion, anodic polarization curves were measured by immersion in a 1N-NaCl and a 1M-$H_2SO_4$+0.1N-NaCl aqueous solutions at 30° C. The obtained results are shown in the following Table 15.

Table 15

| Results of pitting test | | |
|---|---|---|
| Alloy No. | 1N-NaCl, 30° C | 1M-$H_2SO_4$+0.1N-NaCl, 30° C |
| 5–16 | Pitting potential and weight loss could not be detected. Complete passivation. | Pitting potential and weight loss could not be detected. Complete passivation. |
| 304 steel | Pitting occured at potentials higher than OmV(SCE). | Pitting occured at potentials higher than about 120mV(SCE). |
| 316L steel | | |

As seen from Table 15, all of stainless steels including 304 and 316L steels suffered pitting corrosion at a certain pitting potential. On the contrary, the alloys according to the present invention have no susceptibility to pitting corrosion, and hence do not show the pitting potential and weight loss by corrosion, and are completely passivated.

The stress corrosion cracking test was carried out in 42% $MgCl_2$ boiling at 143° C at constant tensile speeds and electrode potentials. The obtained results are shown in the following Table 16. The susceptibility to stress corrosion cracking is represented by the term "$(\epsilon_0-\epsilon)/\epsilon_0$", where $\epsilon$ is the elongation of the sample alloy in the corrosive solution and $\epsilon_0$ is that in air at the same temperature. The higher the value, the higher the susceptibility to stress corrosion cracking.

Table 16

| Results of stress corrosion cracking test | | | | |
|---|---|---|---|---|
| | | | Susceptibility | |
| Potential | | Tensile speed (mm/min) | Alloy No. 5–16 | 304 steel |
| Corrosion potential | | $50\times10^{-3}$ | 0.000 | 0.786 |
| | | $40\times10^{-3}$ | 0.000 | 0.857 |
| | | $7.5\times10^{-3}$ | 0.000 | 0.954 |
| | | $4\times10^{-3}$ | 0.000 | 0.971 |
| Corrosion potential | +100mV | $5\times10^{-2}$ | 0.000 | 0.894 |
| Corrosion potential | ±0mV | $5\times10^{-2}$ | 0.000 | 0.786 |
| Corrosion | | | | |

Table 16-continued

| Results of stress corrosion cracking test | | | | |
|---|---|---|---|---|
| | | | Susceptibility | |
| Potential | | Tensile speed (mm/min) | Alloy No. 5–16 | 304 steel |
| potential | −100mV | $5\times10^{-2}$ | 0.000 | 0.500 |

In general, the susceptibility to stress corrosion cracking is higher the lower the tensile speed and the higher the potential in the vicinity of corrosion potential. This fact is clearly shown in the results of the 304 steel in Table 16. On the other hand, the alloys according to the present invention are not susceptible to stress corrosion cracking even at the potential higher than corrosion potential.

Furthermore, the hydrogen embrittlement test was carried out in a 0.1N-$CH_3COONa$+0.1N-$CH_3COOH$ (pH: 4.67) solution containing $H_2S$ which is often used for hydrogen embrittlement test of steels. The obtained results are shown in the following Table 17. The susceptibility to hydrogen embrittlement can be represented in the same manner as in the susceptibility to stress corrosion cracking.

Table 17

| Results of hydrogen embrittlement test | | | | |
|---|---|---|---|---|
| | | | Susceptibility | |
| Potential | | Tensile speed (mm/min) | Alloy No. 5–16 | Mild steel |
| Corrosion potential | | $4\times10^{-1}$ | 0.000 | 0.227 |
| | | $2\times10^{-1}$ | 0.000 | 0.300 |
| | | $4\times10^{-2}$ | 0.000 | 0.546 |
| | | $4\times10^{-3}$ | 0.000 | 0.672 |
| Corrosion potential | +160mV | $4\times10^{-2}$ | 0.000 | 0.268 |
| Corrosion potential | +60mV | $4\times10^{-2}$ | 0.000 | 0.372 |
| Corrosion potential | ±0mV | $4\times10^{-2}$ | 0.000 | 0.546 |
| Corrosion potential | −60mV | $4\times10^{-2}$ | 0.000 | 0.556 |
| Corrosion potential | −120mV | $4\times10^{-2}$ | 0.000 | 0.587 |
| Corrosion potential | −220mV | $4\times10^{-2}$ | 0.000 | 0.690 |

In general, the susceptibility to hydrogen embrittlement increases when the tensile speed and the potential are lowered. As seen from Table 17, even mild steel, which is less susceptible to hydrogen embrittlement, is fractured by hydrogen embrittlement in hydrogen sulfide by constant tensile speed. On the other hand, the alloys according to the present invention are not susceptible to hydrogen embrittlement.

It follows from the above results that the chromium-bearing iron amorphous alloys according to the present invention have extremely high corrosion resistivity, in particular, against the local corrosion such as pitting and crevice corrosion and the fracture caused by corrosion such as stress corrosion cracking and hydrogen embrittlement. The superiority of these alloys arises from the inherent structure in the amorphous state and the coexistence of chromium and a large amount of semi-metallic elements. Consequently, the superiority cannot be compared with all stainless steels presently used.

Example 5

Amorphous alloys having compositions as shown in the following Table 18 were made into strips having a thickness of 0.2 mm and a width of 0.5 mm by means of the apparatus as shown in FIG. 1.

Table 18

Fe-Cr-C, Fe-Cr-B, Fe-Cr-P series amorphous alloys (atomic %, Fe: balance)

| Component | Fe-Cr-C) | | | | | | Fe-Cr-B | | | | | Fe-Cr-P | | | | |
|---|---|---|---|---|---|---|---|---|---|---|---|---|---|---|---|---|
| | Alloy No. | | | | | | | | | | | | | | | |
| | 1 | 2 | 3 | 4 | 5 | 6 | 7 | 8 | 9 | 10 | 11 | 12 | 13 | 14 | 15 | 16 |
| C | 15 | 20 | 25 | 20 | 20 | 15 | | | | | | | | | | |
| B | | | | | | | 20 | 20 | 18 | 15 | 15 | | | | | |
| P | | | | | | | | | | | | 20 | 20 | 18 | 15 | 15 |
| Cr | 1 | 1 | 1 | 5 | 10 | 20 | 1 | 5 | 10 | 20 | 30 | 1 | 5 | 10 | 20 | 30 |

Each of these strips was tested on mechanical properties, heat resistance and corrosion resistance to obtain results as shown in the following Tables 19, 20 and 21.

Table 19

Mechanical properties of amorphous alloys

| | Alloy No. | Yield strength (Kg/mm²) | Fracture strength (Kg/mm²) | Elongation (%) | Hardness (Hv) | Young's modulus (Kg/mm²) |
|---|---|---|---|---|---|---|
| Fe-Cr-C | 1 | 230 | 250 | 0.05 | 605 | $12.0\times10^3$ |
| | 2 | 240 | 280 | 0.03 | 700 | — |
| | 3 | 255 | 290 | 0.03 | 710 | — |
| | 4 | 280 | 310 | 0.02 | 770 | $13.1\times10^3$ |
| | 5 | 280 | 320 | 0.02 | 810 | $13.5\times10^3$ |
| | 6 | 290 | 330 | 0.02 | 860 | $14.1\times10^3$ |
| Fe-Cr-B | 7 | 230 | 260 | 0.06 | 560 | $12.2\times10^3$ |
| | 8 | 235 | 280 | 0.05 | 700 | $12.7\times10^3$ |
| | 9 | 245 | 295 | 0.05 | 750 | $13.0\times10^3$ |
| | 10 | 250 | 290 | 0.03 | 750 | $13.3\times10^3$ |
| | 11 | 280 | 310 | 0.02 | 790 | $14.1\times10^3$ |
| Fe-Cr-P | 12 | 220 | 250 | 0.05 | 600 | $12.4\times10^3$ |
| | 13 | 240 | 270 | 0.04 | 670 | $13.1\times10^3$ |
| | 14 | 255 | 290 | 0.03 | 720 | $13.3\times10^3$ |
| | 15 | 280 | 305 | 0.02 | 790 | $13.7\times10^3$ |
| | 16 | 290 | 320 | 0.02 | 820 | $14.0\times10^3$ |

Table 20

Heat resistance of amorphous alloys

| Alloy No. | Crystallization temperature (° C) |
|---|---|
| 1 | 380 |
| 2 | 390 |
| 3 | 395 |
| 4 | 405 |
| 5 | 420 |
| 6 | 440 |
| 7 | 370 |
| 8 | 400 |
| 9 | 420 |
| 10 | 440 |
| 11 | 450 |
| 12 | 390 |
| 13 | 405 |
| 14 | 420 |
| 15 | 445 |
| 16 | 460 |

Table 21

Results of corrosions tests in $H_2SO_4$ and NaCl

| Alloy No. | Corrosion rate (mg/cm²/year) 1M-$H_2SO_4$, 30° C | 1N-NaCl, 30° C |
|---|---|---|
| 1 | 900 | 860 |
| 2 | 860 | 820 |
| 3 | 800 | 780 |
| 4 | 11.2 | 20.7 |
| 5 | 0.00 | 0.00 |
| 6 | 0.00 | 0.00 |
| 7 | 870 | 780 |
| 8 | 10.0 | 11.0 |
| 9 | 0.00 | 0.00 |
| 10 | 0.00 | 0.00 |
| 11 | 0.00 | 0.00 |
| 12 | 540 | 530 |
| 13 | 6.40 | 6.02 |
| 14 | 0.00 | 0.00 |
| 15 | 0.00 | 0.00 |
| 16 | 0.00 | 0.00 |

As seen from Table 19, the amorphous structure can be produced even by adding any one of C, B and P to Fe-Cr series alloy. Particularly, when each of these elements is added in an amount of 15 to 25 atomic %, the amorphous alloy can be most easily obtained. Furthermore, the mechanical properties such as yield strength, fracture strength and hardness are improved with the increase of the chromium content.

As seen from Table 20, the crystallization temperature is raised by increasing the chromium content, so that the hat resistance is considerably improved.

In general, it is desirable that a combination of at least two elements of C, B and P is used in order to obtain an amorphous structure, but even if these elements are used alone, the amorphous structure can be obtained by quenching the melt from high temperature.

Example 6

Iron-chromium series amorphous alloys having compositions as shown in the following Table 22 were made into strips having a thickness of 0.05 mm and a width of 1 mm by means of the apparatus as shown in FIG. 1.

Table 22

Fe-Cr-M-P-C-B series amorphous alloys (atomic %, Fe: balance)

| Alloy No. | Cr | P | C | B | M | Alloy No. | Cr | P | C | B | M |
|---|---|---|---|---|---|---|---|---|---|---|---|
| | Component | | | | | | Component | | | | |
| 1 | 1 | 13 | 7 | | 5 Ni | 25 | 8 | 15 | | 8 | 10 Ti |
| 2 | 1 | 13 | 7 | | 10 Ni | 26 | 8 | 12 | 2 | 10 | 9 V |
| 3 | 1 | 13 | 7 | | 20 Ni | 27 | 8 | 12 | 2 | 10 | 9 Nb |
| 4 | 1 | 13 | 7 | | 40 Ni | 28 | 8 | 12 | 2 | 10 | 9 Ta |
| 5 | 3 | 13 | 5 | 2 | 10 Ni | 29 | 8 | 12 | 2 | 10 | 9 W |
| 6 | 5 | 13 | 5 | 2 | 10 Ni | 30 | 5 | 13 | 7 | | 10 Ni<br>5 Mo<br>1 Nb<br>2 Cu |
| 7 | 8 | 13 | | 7 | 10 Ni | | | | | | |
| 8 | 1 | 13 | | 7 | 5 Co | 31 | 5 | 13 | 2 | 7 | 10 Co<br>5 Mo<br>3 V |
| 9 | 1 | 13 | | 7 | 15 Co | | | | | | |
| 10 | 1 | 13 | | 7 | 35 Co | 32 | 5 | 15 | | 7 | 15 Ni<br>5 Zr<br>3 Ti |
| 11 | 3 | 13 | | 7 | 10 Co | | | | | | |
| 12 | 5 | 13 | | 7 | 10 Co | 33 | 5 | 15 | 2 | 5 | 15 Co<br>5 Nb<br>2 Cu |
| 13 | 8 | 13 | | 7 | 10 Co | | | | | | |
| 14 | 1 | 13 | 2 | 5 | 3 Cu | 34 | 5 | 15 | | 7 | 10 Mn<br>2 Zr<br>2 Cu |
| 15 | 1 | 13 | 2 | 7 | 5 Cu | | | | | | |
| 16 | 3 | 13 | 2 | 7 | 5 Cu | 35 | 8 | 13 | | 7 | 15 Ni<br>3 Mo<br>3 Nb |
| 17 | 1 | 15 | | 10 | 10 Mn | | | | | | |
| 18 | 3 | 15 | 10 | 10 Mn | | 36 | 10 | 10 | 7 | 3 | 10 Ni<br>5 Mo<br>2 Zr<br>1 V |
| 19 | 5 | 15 | | 10 | 10 Mn | | | | | | |
| 20 | 8 | 10 | 5 | 5 | 5 Mo | 37 | 3 | 13 | | 7 | 20 Ni<br>15 Co<br>5 Mo<br>3 W |
| 21 | 8 | 10 | 5 | 5 | 10 Mo | | | | | | |
| 22 | 8 | 10 | 2 | 10 | 5 Zr | 38 | 5 | 18 | | | 15 Ni<br>3 Mo<br>3 Ta<br>1 Ti |
| 23 | 8 | 10 | 2 | 10 | 10 Zr | | | | | | |
| 24 | 8 | 15 | | 8 | 5 Ti | | | | | | |

Each of these strips was tested on mechanical properties, heat resistance and corrosion resistance to obtain results as shown in the following Table 23.

Table 23

Mechanical properties, heat resistance and corrosion resistance of Fe-Cr-M-P-C-B series alloys

| Alloy No. | Hardness (Hv) | Fracture strength (Kg/mm²) | Elongation (%) | Fatigue limit (Kg/mm²) | Crystallization temperature (° C) | Corrosion rate (mg/cm²/year) 1M-$H_2SO_4$, 30° C | Corrosion rate (mg/cm²/year) 1N-NaCl, 30° C |
|---|---|---|---|---|---|---|---|
| 1 | 750 | 300 | 0.03 | 120 | 420 | 52 | 45 |
| 2 | 730 | 300 | 0.05 | 120 | 410 | 30 | 32 |
| 3 | 690 | 280 | 0.09 | 110 | 400 | 21 | 3 |
| 4 | 650 | 260 | 0.05 | 105 | 380 | 5.2 | 2.1 |
| 5 | 745 | 300 | 0.04 | 115 | 420 | 0.50 | 0.08 |
| 6 | 760 | 310 | 0.03 | 115 | 440 | 0.00 | 0.00 |
| 7 | 790 | 320 | 0.02 | 120 | 445 | 0.00 | 0.00 |
| 8 | 770 | 310 | 0.03 | 120 | 415 | 77 | 68 |
| 9 | 790 | 320 | 0.04 | 120 | 400 | 50 | 47 |
| 10 | 800 | 330 | 0.02 | 130 | 375 | 7.1 | 5.4 |
| 11 | 800 | 320 | 0.04 | 120 | 415 | 0.10 | 0.07 |
| 12 | 815 | 330 | 0.02 | 130 | 420 | 0.00 | 0.00 |
| 13 | 840 | 340 | 0.02 | 135 | 430 | 0.00 | 0.00 |
| 14 | 750 | 300 | 0.02 | 120 | 405 | 9.3 | 7.5 |
| 15 720 | 290 | 0.04 | 115 | 390 | 2.1 | 0.5 | |
| 16 | 760 | 310 | 0.03 | 120 | 400 | 0.0 | 0.0 |
| 17 | 780 | 320 | 0.03 | 120 | 405 | 560 | 242 |
| 18 | 790 | 320 | 0.02 | 110 | 410 | 3.5 | 3.0 |
| 19 | 800 | 320 | 0.02 | 115 | 420 | 0.00 | 0.00 |
| 20 | 870 | 340 | 0.02 | 130 | 465 | 0.00 | 0.00 |
| 21 | 920 | 360 | 0.02 | 145 | 485 | 0.00 | 0.00 |

Table 23-continued

Mechanical properties, heat resistance and corrosion resistance of Fe-Cr-M-P-C-B series alloys

| Alloy No. | Hardness (Hv) | Fracture strength (Kg/mm²) | Elongation (%) | Fatigue limit (Kg/mm²) | Crystallization temperature (° C) | Corrosion rate (mg/cm²/year) 1M-$H_2SO_4$, 30° C | 1N-NaCl, 30° C |
|---|---|---|---|---|---|---|---|
| 22 | 850 | 340 | 0.01 | 135 | 445 | 0.00 | 0.00 |
| 23 | 890 | 350 | 0.02 | 140 | 485 | 0.00 | 0.00 |
| 24 | 850 | 330 | 0.02 | 115 | 455 | 0.00 | 0.00 |
| 25 | 880 | 350 | 0.02 | 115 | 460 | 0.00 | 0.00 |
| 26 | 860 | 340 | 0.02 | 120 | 470 | 0.00 | 0.00 |
| 27 | 880 | 350 | 0.02 | 120 | 500 | 0.00 | 0.00 |
| 28 | 890 | 350 | 0.02 | 115 | 505 | 0.00 | 0.00 |
| 29 | 910 | 360 | 0.02 | 110 | 490 | 0.00 | 0.00 |
| 30 | 990 | 380 | 0.04 | 160 | 430 | 0.00 | 0.00 |
| 31 | 970 | 370 | 0.05 | 160 | 430 | 0.00 | 0.00 |
| 32 | 950 | 360 | 0.04 | 150 | 435 | 0.00 | 0.00 |
| 33 | 950 | 360 | 0.04 | 155 | 405 | 0.00 | 0.00 |
| 34 | 860 | 340 | 0.02 | 105 | 395 | 0.00 | 0.00 |
| 35 | 990 | 380 | 0.06 | 160 | 430 | 0.00 | 0.00 |
| 36 | 1,010 | 400 | 0.08 | 180 | 460 | 0.00 | 0.00 |
| 37 | 960 | 370 | 0.10 | 170 | 410 | 0.00 | 0.00 |
| 38 | 970 | 370 | 0.08 | 170 | 430 | 0.00 | 0.00 |

As seen from Table 23, the addition of Mo, Zr, Ti, V, Nb, Ta, W, Mn, and Co increases the hardness, fracture strength and fatigue limit, while the addition of Ni and Cu decreases these properties to a some extent. The fracture strength and fatigue limit are substantially proportional to the hardness, respectively. Thus, the addition effect of each element for the hardness $Fe_{80-x}M_xP_{13}C_7$ alloys is approximately expressed by the following equation:

Hardness of alloy ($Hv$) = 760+8×(Cr at %)+9×(Mo+W at %)+6×(Zr+Nb+Ta at %)+5×(Ti at %)+4×(V at %)+1.5×(Co at %)+0.5×(Mn at %)−4×(Ni at %)−9×(Cu at %)

Furthermore, as seen from Table 23, the heat resistance is improved by the addition of Mo, W, Zr, Nb, Ta, Ti, and V, but is degraded by the addition of Co, Ni, Mn, and Cu. The addition effect of each element for the heat resistance of the alloy is expressed by the following equation:

Crystallization temperature of alloy (°C) = 420+3.0×(Cr at%)+3.5×(Mo+W at%)+4.0×(Zr+Nb+Ta at%)+2.8×(Ta at%)+1.5×(Ti at%)−1.5×(Co at%)−1.0×(Ni at%)−

Relating to the corrosion resistance, the effect by the addition of chromium is most remarkable, and further the coexistence of Ni, Mn, Co, and Cu improves the corrosion resistance as seen from Table 23. The addition of Mo, Zr, Ti, V, Nb, Ta, and W is slightly effective.

Moreover, several corrosion tests were carried out with respect to the above strips in the same manner as described in Example 4 to obtain results as shown in the following Tables 24–28.

Table 24

Results of corrosion tests in HCl

| Alloy No. | Concentration of hydrochloric acid (N) 30° C: 0.01 Corrosion rate (mg/cm²/year) | 0.01 Appearance | 0.1 Corrosion rate (mg/cm²/year) | 0.1 Appearance | 0.5 Corrosion rate (mg/cm²/year) | 0.5 Appearance | 1 Corrosion rate (mg/cm²/year) | 1 Appearance |
|---|---|---|---|---|---|---|---|---|
| 1–4<br>7–10<br>14,15<br>17,18 | 0.00 | no corrosion | 0.00 | no corrosion | <0.5 | corrosion slightly occurred | <2.0 | corrosion slightly occurred |
| 5,6<br>11–13<br>16<br>19–38 | 0.00 | no corrosion | 0.00 | no corrosion | 0.00 | no corrosion | 0.00 | no corrosion |
| 304 steel | 1.03 | general corrosion | 3.28 | general corrosion | 572.2 | general corrosion +pitting +crevice corrosion | 10,210 | general corrosion +pitting +crevice corrosion |

Table 25

Results of pitting test

| Alloy No. | 10% $FeCl_3.6H_2O$, 40° C: Time for appearance of pitting (hour) | 40° C: Corrosion rate (mg/cm²/year) | 60° C: Time for appearance of pitting (hour) | 60° C: Corrosion rate (mg/cm²/year) |
|---|---|---|---|---|
| 1–38 | No pitting even after 168 hour-immersion | 0.00 | No pitting even after 168 hour-immersion | 0.00 |
| 304 steel 316L | 18 | 13.8 | 3 | 93.6 |

Table 25-continued

| Results of pitting test | | | | |
|---|---|---|---|---|
| | 10% $FeCl_3.6H_2O$ | | | |
| | 40° C | | 60° C | |
| Alloy No. | Time for appearance of pitting (hour) | Corrosion rate (mg/cm²/year) | Time for appearance of pitting (hour) | Corrosion rate (mg/cm²/year) |
| steel | — | — | 8 | 21.4 |

Table 26

| Results of pitting test | | |
|---|---|---|
| Alloy No. | 1N-NaCl, 30° C | 1M-$H_2SO_4$+0.1N-NaCl, 30° C |
| 1–38 | Pitting potential and weight loss could not be detected. Complete passivation. | Pitting potential and weight loss could not be detected. Complete passivation. |
| 304 steel<br>316L steel | Pitting occured at potentials higher than OmV(SCE) | Pitting occured at potentials higher than about 120mV(SCE). |

Table 27

| Results of stress corrosion cracking test | | | |
|---|---|---|---|
| | | Susceptiblity | |
| Potential | Tensile speed (mm/min) | Alloy No. 1–38 | 304 steel |
| Corrosion potential | $50\times10^{-3}$ | 0.000 | 0.786 |
| | $40\times10^{-3}$ | 0.000 | 0.857 |
| | $7.5\times10^{-3}$ | 0.000 | 0.954 |
| | $4\times10^{-3}$ | 0.000 | 0.971 |
| Corrosion potential +100mV | $5\times10^{-2}$ | 0.000 | 0.894 |
| Corrosion potential ±0mV | $5\times10^{-2}$ | 0.000 | 0.786 |
| Corrosion potential −100mV | $5\times10^{-2}$ | 0.000 | 0.500 |

Table 28

| Results of hydrogen embrittlement test | | | |
|---|---|---|---|
| | | Susceptibility | |
| Potential | Tensile speed (mm/min) | Alloy No. 1–38 | Mild steel |
| Corrosion potential | $4\times10^{-1}$ | 0.000 | 0.227 |
| | $2\times10^{-1}$ | 0.000 | 0.300 |
| | $4\times10^{-2}$ | 0.000 | 0.546 |
| | $4\times10^{-3}$ | 0.000 | 0.672 |
| Corrosion potential +160mV | $4\times10^{-2}$ | 0.000 | 0.268 |
| Corrosion potential +60mV | $4\times10^{-2}$ | 0.000 | 0.372 |
| Corrosion potential ±0mV | $4\times10^{-2}$ | 0.000 | 0.546 |
| Corrosion potential −60mV | $4\times10^{-2}$ | 0.000 | 0.556 |
| Corrosion potential −120mV | $4\times10^{-2}$ | 0.000 | 0.587 |

What is claimed is:

1. Iron-chromium completely amorphous alloys having excellent mechanical properties, high heat resistance and corrosion resistance, consisting essentially of 1–40 atomic % of chromium, 7–35 atomic % of at least one of elements selected from the group consisting of carbon, boron and phosphorus and the remainder being iron.

2. Iron-chromium completely amorphous alloys having excellent mechanical properties, high heat resistance and corrosion resistance, consisting essentially of 1–40 atomic % of chromium, 2–30 atomic % of at least one of carbon and boron, 5–33 atomic % of phosphorus, the total amount of phosphorous and at least one of carbon and boron, being 7–35 atomic % and the remainder being iron.

3. Iron-chromium amorphous alloys as claimed in claim 1, wherein said amorphous alloys additionally contain less than 40 atomic % of at least one of nickel and cobalt.

4. Iron-chromium amorphous alloys as claimed in claim 1, wherein said amorphous alloys additionally contain less than 20 atomic % of at least one of molybdenum, zirconium, titanium and manganese.

5. Iron-chromium amorphous alloys as claimed in claim 1, wherein said amorphous alloys additionally contain less than 10 atomic % of at least one of vanadium, niobium, tungsten, tantalum and copper.

6. Iron-chromium amorphous alloys as claimed in claim 2, wherein said amorphous alloys additionally contain less than 40 atomic % of at least one of nickel and cobalt.

7. Iron-chromium amorphous alloys as claimed in claim 2, wherein said amorphous alloys additionally contain less than 20 atomic % of at least one of molybdenum, zirconium, titanium and manganese.

8. Iron-chromium amorphous alloys as claimed in claim 2, wherein said amorphous alloys additionally contain less than 10 atomic % of at least one of vanadium, niobium, tungsten, tantalum and copper.

9. The iron-chromium amorphous alloys as claimed in claim 1, wherein the amount of at least one of carbon, boron and phosphorous is 15–25 atomic %.

10. The iron-chromium amorphous alloys as claimed in claim 2, wherein the amount of at least one of carbon and boron is 5–10 atomic % and the amount of phosphorus is 8–15 atomic %.

11. Iron-chromium amorphous alloys as claimed in claim 1, wherein said amorphous alloys additionally contain at least one of sub-component selected from the group consisting of nickel, cobalt, molybdenum, zirconium, titanium, manganese, vanadium, niobium, tungsten, tantalum and copper, provided that the content of at least one of nickel and cobalt being less than 40 atomic %, the content of at least one of molybdenum, zirconium, titanium and manganese being less than 20 atomic % and the content of at least one of vanadium, niobium, tungsten, tantalum and copper being less than 10 atomic %.

* * * * *